United States Patent [19]

Raudat

[11] 4,203,271

[45] May 20, 1980

[54] INDEXING APPARATUS FOR CASE PACKER

[75] Inventor: John L. Raudat, Madison, Conn.

[73] Assignee: Standard-Knapp, Inc., Portland, Conn.

[21] Appl. No.: 963,368

[22] Filed: Nov. 24, 1978

[51] Int. Cl.[2] ..... B65B 43/48

[52] U.S. Cl. ..... 53/250; 198/485

[58] Field of Search .....53/249, 250, 251; 198/429, 430, 485

[56] References Cited

U.S. PATENT DOCUMENTS

| | | | |
|---|---|---|---|
| 2,713,448 | 7/1955 | Wimmer et al. | 53/250 X |
| 3,103,772 | 9/1963 | Anderson | 53/148 X |
| 3,279,145 | 10/1966 | Williamson | 53/236 X |

*Primary Examiner*—Travis S. McGehee

*Attorney, Agent, or Firm*—McCormick, Paulding & Huber

[57] ABSTRACT

Cases are accumulated in end-to-end relationship on a continuously driven infeed conveyor and stop means is provided adjacent the downstream end to selectively advance several cases in a group onto a pusher conveyor of the endless chain type. A lift table at the downstream end of the pusher conveyor raises these cases upwardly at a packing station where they are loaded with slugs of articles appropriately segregated for being dropped into the upwardly open packing cases in accordance with conventional practice. The packer accommodates the cases in each group in indexed relationship to one another and means is provided for so indexing the end-to-end cases. The endless pusher conveyor is spaced downwardly of the level of the cases on the infeed conveyor such that the second case in a group of two cases is received in a canted configuration with its leading edge supported on the top of the pusher associated with the first case. Fixed case camming means engages the outwardly projecting top flaps of the cases to urge or strip each of the cases rearwardly into its associated pusher before these cases are advanced to position for being lifted at the packing station. A pusher backup means is associated with the pusher conveyor chains to cause the pushers to be reversed in direction as the cases are being raised at the packing station in order to prevent interference when these cases are again returned to the pusher conveyor in order to be ejected from the packing station.

4 Claims, 7 Drawing Figures

7
7

INDEXING APPARATUS FOR CASE PACKER

SUMMARY OF INVENTION

This invention relates generally to case packers, and deals more particularly with an indexing apparatus suitable for feeding two or more cases to a single packing station at the same time, which cases are acurately indexed with respect to one another so as to be vertically aligned with the grid structure normally provided at the packing station in a typical case packer.

The general aim of the present invention is to provide a case indexing apparatus wherein end-to-end cases are adapted to be fed two at a time to a packing station in a case packer, and to be indexed with respect to one another in order to be vertically aligned below the grid structure where the articles to be packed in the cases are prepositioned prior to being dropped into these upwardly open packing cases.

In carrying out the present invention for indexing cases in a cylically operable case packer of the type which is adapted to pack two or more cases with appropriately grouped slugs of articles at a packing station, case infeed conveyor means is provided for advancing the cases along a first path where the cases are arranged in end-to-end relationship, and stop means is provided in association with this infeed conveyor for selectively interrupting the movement of cases being advanced along this first path. The stop means is movable cylically to pass one group of two articles at a time, in predetermined timed relationship with the packer itself. The case indexing apparatus includes an intermittently driven case pusher means, of the endless chain type, for receiving each of the groups of articles so segregated by the stop means and said pusher conveyor defines a second path for the group of articles, downstream of the first path and spaced slightly below said first path. Where two such cases are provided in each group the first is dropped between the last pusher associated with the previous group of cases and the first pusher in the next succeeding group, and the second case is dropped with its leading edge on top of this first pusher associated with the first case. Case camming means is provided at a downstream location to urge, or strip each of these cases rearwardly into a pusher associated with it, and this action serves to accurately index the cases when they reach the packing station. The pusher conveyor is intermittently driven, and two groups of cases are accommodated on the upper run of the pusher conveyor. A lift table associated with the packing station of the case packer lifts the upwardly open, indexed cases, so that they can mate with a conventional drop grid assembly which will gravity feed the slugs of articles, formed for this purpose in the grid, into these cases, after which the cases will be returned to the pusher conveyor for transport out of the packing station. During this packing phase the intermittently driven pusher conveyor is reversed in direction by suitable means associated with its driven end, which means is adapted to take advantage of the slack normally provided in the return side of the drive chain of such a conveyor to shift the slack from the return run to the upper run of the pusher conveyor. Thus, the filled cases do not inadvertently engage the locating pushers provided on the pusher conveyor at the packing station as they are returned thereto by the lift table.

DETAILED DESCRIPTION

Figure 4:
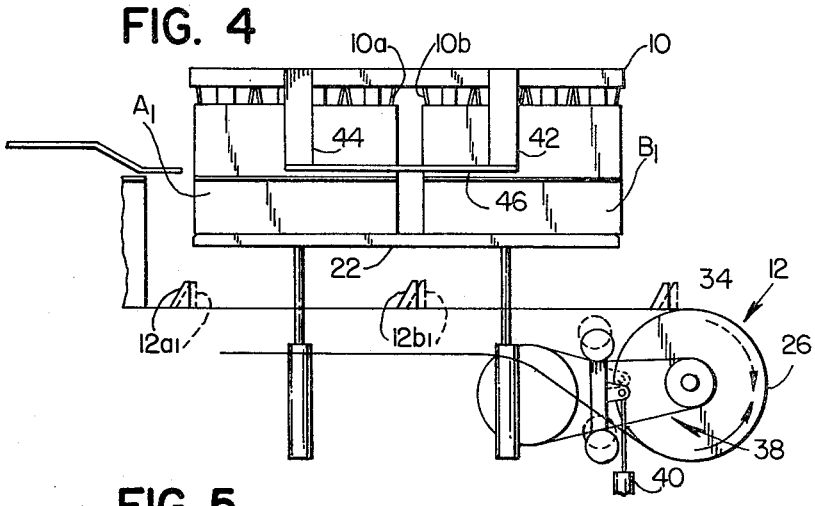
FIG. 4 illustrates the packing station of the apparatus of FIGS. 1 and 3, and also illustrates in schematic fashion a portion of the grid structure through which the slugs of articles to be loaded are adapted to pass as they enter the upwardly open packing cases, the pushers associated with the cases being illustrated in two positions in FIG. 4, the broken line position indicating the positions of the pushers from FIG. 3, the solid line positions in FIG. 4 illustrating the positions of the pushers at a slightly later instant of time.

Turning now to the drawings in greater detail, the case indexing apparatus of the present invention is intended for use with a typical case packer of the type having facility for accumulating at least two slugs of articles to be simultaneously drop packed into two upwardly open packing cases at a packing station as illustrated in FIG. 4. The lower portion of the grid structure in such a case packer, and more particularly the funnel defining portion thereof, is illustrated generally at 10 in FIG. 4, and as there shown two upwardly open cases A1 and B1 have mated with the two separate funnel defining portions 10*a* and 10*b* in the case packer so as to guide the articles as they drop downwardly through the funnel structure 10 from the grid into the awaiting cases at the packing station. The articles themselves are not shown, nor are details of the grid structure itself and it is a feature of the present invention that the case indexing apparatus to be described can be adapted for use with case packers of various types. However, it is characteristic of such case packers that the slugs or groups of articles to be packed are generally oriented so that each of the articles within a particular slug must be guided inwardly toward the center of the awaiting case during the packing operation. For this reason, two such cases, as indicated generally at A1 and B1 in FIG. 4 cannot be packed in end-to-end relationship with respect to one another because of the necessity for then diverting the articles on the outside of the grid funnel structure 10 through too great a horizontal, sidewise, displacement. The case indexing apparatus to be described, therefore, has as its chief aim the indexing of two cases to properly locate these cases at the packing station, and more specifically to index these cases in slightly spaced relationship with respect to one another at the packing station as shown in FIG. 4.

Figures 1, 2, 3:
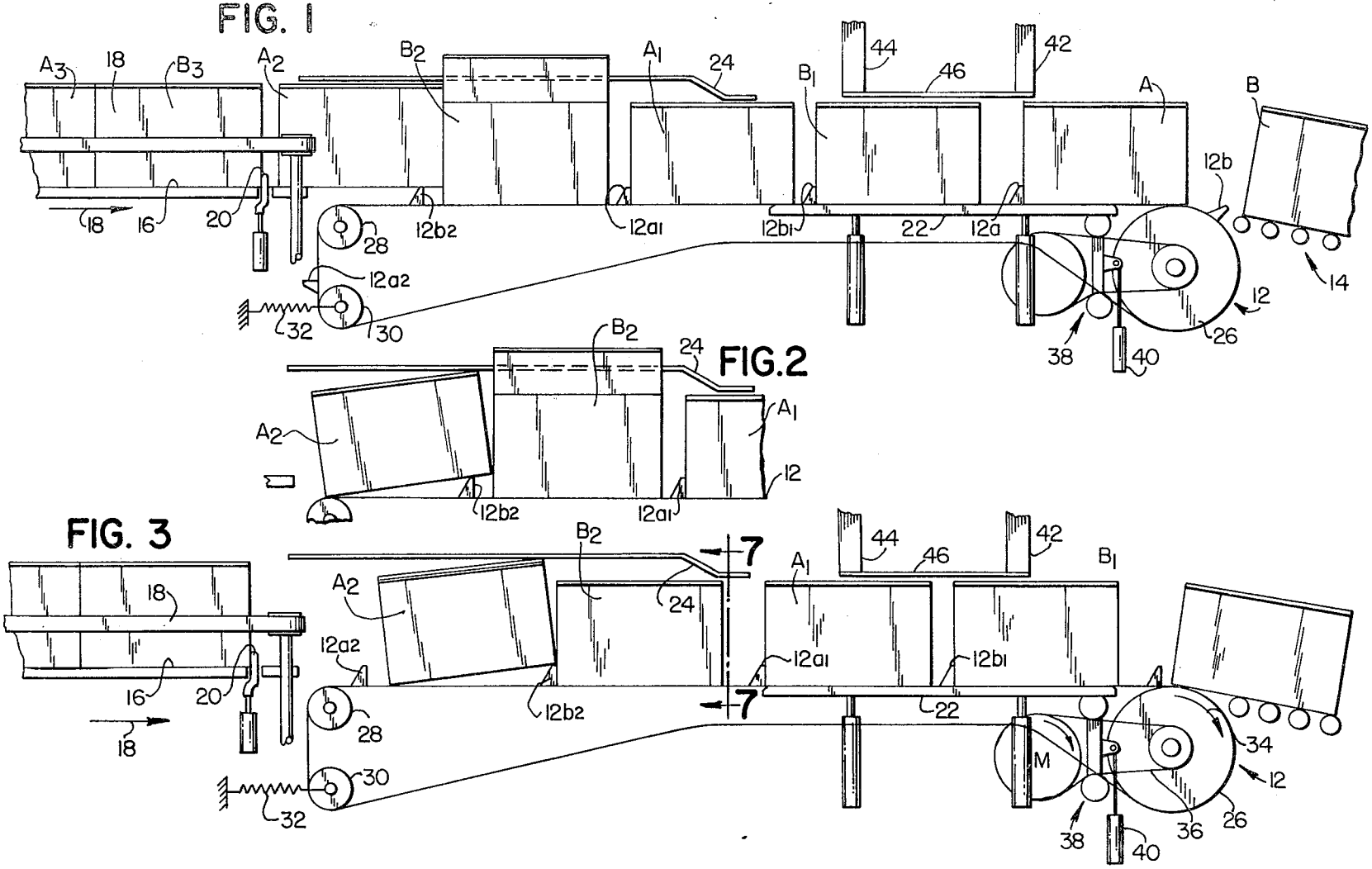
FIG. 1 is a side elevational view illustrating in schematic fashion the case indexing apparatus together with the lift table associated with the packing station of the case packer.
FIG. 2 is a view similar to a segment of the case indexing apparatus shown in FIG. 1, but at a slightly later instant of time.
FIG. 3 is a view similar to FIG. 1, but at an instant of time slightly later than that of FIG. 2.
Figure 5:
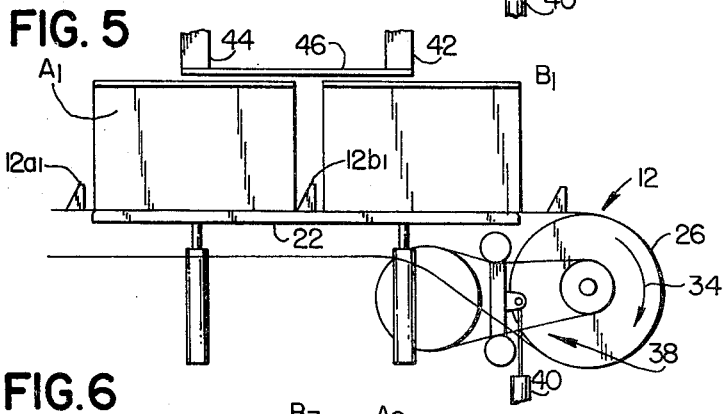
FIG. 5 is a view similar to FIG. 4 but illustrates the packed cases after they have been filled and returned to the conveyor.
Figure 6:
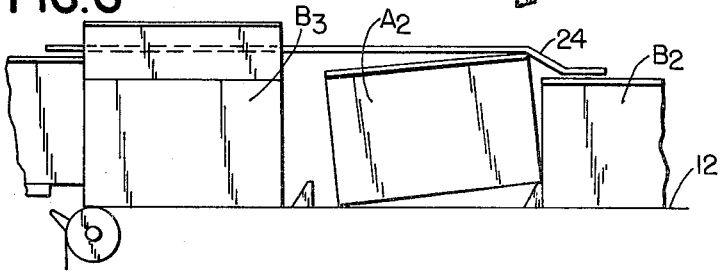
FIG. 6 illustrates the same portion of the case indexing apparatus as revealed in FIG. 2 but is taken at a slightly later instant of time than that shown in FIG. 5, and just prior to the time frame depicted in FIG. 1.

Turning next to FIG. 1, the packing station is there shown at the right hand side of this view after the two cases A and B have been filled and are in the process of being discharged from the packing station by reason of movement of the intermittently driven pushers 12*a* and 12*b* associated with the pusher conveyor 12. A ramp 14 is defined by inclined idler rollers in order to carry away the filled cases for further processing. Thus, FIG. 1 shows the pusher conveyor 12 in the process of moving cases downstream or toward the right in this view and it will be appreciated that this conveyor 12 is intermittenly driven so as to allow sufficient time at the packing station for raising the cases located there from the FIG. 3 position to the FIG. 4 position to allow for loading and for returning these loaded cases to the FIG. 5 position where they can be discharged upon further movement of the intermittent conveyor 12. The means for delivering two cases at a time to this intermittently driven conveyor 12 will now be described in detail.

Means is provided for accumulating a line of cases on a conveyor structure which includes a horizontally extending surface or deadplate 16 across which these cases are adapted to be continuously urged by side belts 18 provided for this purpose on either side of the deadplate 16. As so constructed and arranged a first path is provided where the cases are arranged in end-to-end relationship so that they are urged continuously in the downstream direction indicated by the arrow 18 against a retractable stop 20 which stop is timed to release a group of these cases, preferably two, in timed relationship with the operation of the intermittent pusher conveyor 12, and also in timed relationship with respect to the lift table 22 described previously with reference to the packing station. While FIG. 1 shows two cases A2 and B2 having been released from the infeed conveyor it will be apparent that these two cases are still oriented in end-to-end relationship with respect to one another and it will also be apparent that the leading case B2 is provided between the pushers $12a_1$ and $12b_2$. The spacing between these adjacent pushers is greater than is the spacing between pushers in a group, $12a_1$ and $12b_1$ for example, and this latter spacing is the spacing which will determine the indexed relationship between the cases at the packing station. The greater spacing between the last pusher within one group of pushers and the first pusher within the next succeeding group of pushers is convenient in order to provide an appropriate space for the leading case in each particular group of cases, such as B2 for example, order that no interference is created between these pushers and the case itself. The next succeeding case in the group (A2) is purposely caused to engage the pusher $12b_2$ as shown in FIGS. 1, 2 and 3. It is noted that the upper run of pusher conveyor 12 is provided in slightly downwardly spaced relationship to the first path defined by the case infeed conveyor, and more particularly by approximately the height of the pushers such as that indicated at $12b_2$. This geometry provides for the trailing edge of the case A2 in FIG. 2 to drop downwardly as it leaves the case infeed conveyor structure with the result that this case A2 will be canted slightly as shown.

Figure 7:
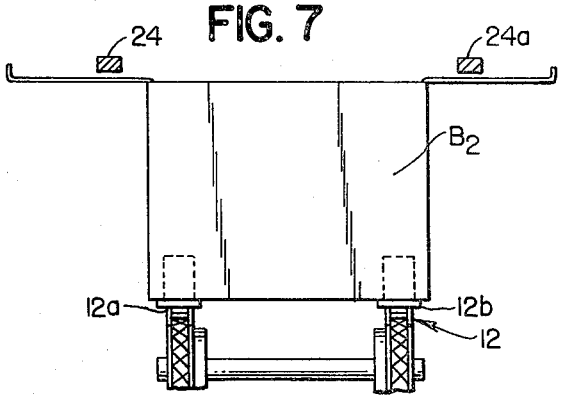
FIG. 7 is sectional view taken generally along the line 7—7 of FIG. 3 illustrating the case camming means for urging each of the cases rearwardly into an associated pocket defined by individual pushers on the pusher conveyor illustrated in detail in FIGS. 1 through 6 inclusively.

It is a feature of the present invention that case camming means 24 is provided above the path of cases on the pusher conveyor in order to urge each of the cases rearwardly or in the upstream direction as the cases are fed downstream by the intermittent conveyor 12. Actually, the case camming means comprises two separate guide bars, 24 and 24*a* in FIG. 7, so arranged as to engage the open top flaps of the case B2 and to thereby serve two purposes. First, these flaps are held open by these guide bars 24 and 24*a*, and secondary these guide bars serve to urge each of the cases in turn rearwardly as the cases are advanced by the conveyor 12 so that each case contacts its associated pusher as can be seen by a close comparison of the case B2 in FIGS. 2 and 3. The second succeeding case in this particular group of cases (A2) is similarly stripped rearwardly back into the pocket defined by its associated pusher $12a_2$ at a slightly later instant of time and only after the preceeding case B2 has been so located by the case camming bar 24. The spacing between the pushers $12a_2$ and $12b_2$ defines the spacing between the cases at the packing station where they will be lifted by the table 22 as described above. The lift table is segmented to provide a portion between the chains of conveyor 12 according to conventional practice.

FIG. 3 actually shows the stop position for the intermittently driven pusher conveyor 12 and the cases A1 and B1 are located in indexed relationship with respect to one another such that the lift table 22 can raise these cases upwardly as shown by a comparison between FIGS. 3 and 4. As the lift table 22 moves into its FIG. 4 position the pusher conveyor 12 will be retracted slightly by a mechanism to be described.

The pusher conveyor comprises two parallel endless chains 12*a* and 12*b* entrained around sprocket means provided at the upstream and downstream ends of this conveyor and indicated generally at 26 and 28 in FIGS. 1 and 3. The upper run of these endless chains defines the second path for the cases as they move, intermittently, from the infeed conveyor to the packing station. The lower run of the pusher conveyor 12 has a slack take up sprocket 30 associated therewith and said sprocket is adapted to being urged toward the left, or the upstream direction as suggested by the spring 32. The downstream sprocket 26 is driven in the direction of the arrow 34 by a motor M and associated drive chain 36 entrained over a sprocket associated with the output shaft of the motor M and a smaller sprocket coaxially arranged with respect to the driven sprocket 28. A vertically reciprocable idler sprocket structure 38 is movable between the positions shown in FIG. 4 in order to act upon the drive chain 36 such that slack in the return side of this drive chain is normally taken up by this idler sprocket structure 38 as shown in FIGS. 1 and 3. When this idler sprocket structure 38 is shifted to the position shown for it in FIGS. 4 and 5, by the air cylinder 40, the slack in the drive chain 36 is shifted to the upper run of the drive chain 38 with the result that the sprocket 26 is rotated in a counterclockwise direction, and the various pushers $12a_1$ and $12b_1$ on the top of conveyor 12 are reversed in direction to move slightly in the upstream direction and provide clearance between the trailing edge of each of the cases A1 and B1 on the lift table and their associated pushers. As the cases A1 and B1 are lowered downwardly, to be returned to the pusher conveyor 12 for discharge from the packing station, the structure 38 is returned to its normal position, and these cases are discharged as described above.

As mentioned previously the case camming means 24 acts upon each of the cases in turn as it is fed, in its group of cases, along the upper run of the infeed conveyor 12 to urge each of the cases into contact with it's associated pusher thereby locating the cases with respect to one another for proper spacing when these cases reach the packing station. However, the case camming means 24 terminates just short of the upstream edge of the lift table 22 with the result that further guide means is preferably employed in order to assure that this spacing between the cases is maintained during movement of the cases further downstream into the packing station. A pair of depending leaf springs 42 and 44 are provided in fixed structure at the packing station, with a cross bar 46 joining their free end portions as shown. As so constructed and arranged these members 42, 44 and 46 cooperate to engage the top flaps of the cases while they are traveling downstream into the packing station in order to assure that the cases remain in contact with their associated pushers. In addition, these left spring guide means also serve to maintain the top flaps of the upwardly open cases in an open configuration as they are raised by the lift table 22 at the packing station therey avoiding interference between these top flaps and the grid structure 10 described above.

I claim:

1. In a cylically operable case packer for packing cases with slugs of articles, the combination comprising means for simultaneously raising groups of at least two cases for loading at a packing station where slugs of articles are adapted to be dropped into these cases, case indexing apparatus for spacing said cases at the packing station and including case infeed conveyor means for advancing cases to be indexed along a first path where the cases are arranged in end-to-end relationship, stop means associated with said infeed conveyor for selectively interrupting the movement of cases advancing along said path and said stop means movable cyclically to pass one group of at least two cases in predetermined timed relationship with said packer, said case indexing apparatus further including intermittently driven case pusher means for receiving said group of at least two cases passing said stop means, said case pusher means defining a second path for said group of cases downstream of the first path and spaced slightly below said first path, said case pusher means having groups of pushers on endless chains and being so timed with respect to said stop means as to receive the first case of said one group of cases between the last pusher in one group of pushers and the first pusher in the next succeeding group of pushers whereby the second case in said group is supported partly on said intermittently driven chain and partly on said first pusher as a result of its end-to-end relationship, with the first case in that group, said intermittent conveyor having a speed when reached approximating the said infeed conveyor, said case indexing apparatus further including case camming means associated with said second path for engaging each case in said group to urge it into engagement with an associated pusher whereby the cases are indexed with respect to one another prior to being raised at the packing station.

2. The combination defined by claim 1 further characterized by said intermittently driven case pusher means having such a length and defining sufficient pushers for handling at least two groups of cases along said second path, that group of said two groups which is furthest downstream being located at said packing station and the means for raising the cases in said downstream group comprising a lift table operable between said endless chain, and means for selectively moving said chains and pushers associated with said second path in the upstream direction to provide clearance between the cases to be lifted and thereby also providing clearance therebetween when the filled cases are returned onto the intermittent conveyor or by lowering the lift table.

3. The combination defined in claim 1 wherein said intermittently driven case pusher means includes sprocket means at opposite ends of said second path, which second path is defined by the upper run of an endless chain and said chain being entrained around said sprocket means, one of said sprocket means at the downstream end of said second path being driven, drive means for said one sprocket means and including a drive chain and idler sprocket means engageable with said drive chain to hold it in a normal drive orientation, and means for selectively shifting said idler sprocket means to shift the drive chain between its normal drive orientation to a second position to backup said drive sprocket means and hence the pushers on said intermittently driven endless chain conveyor.

4. In a cyclically operable case packer for packing cases with slugs of articles, the combination comprising means for simultaneously raising at least one case for loading at a packing station where the articles are adapted to be dropped into the case, case infeed means including an intermittently driven endless chain conveyor means having pushers for indexing cases cyclically along its upper run so that at least one case at a time can be raised at said packing station, said conveyor means including sprocket means at opposite ends of said endless chain conveyor, one of said sprocket means at the downstream end thereof being driven, drive means for said one sprocket means and including a drive chain and idler sprocket means engageable with said drive chain to hold it in a normal drive orientation, and means for selectively shifting said idler sprocket means to shift the drive chain between its normal drive orientation to a second position to backup said drive sprocket means and hence the pushers on said intermittently driven endless chain conveyor.

* * * * *